United States Patent [19]

Toyota et al.

[11] 4,013,017

[45] Mar. 22, 1977

[54] REMOTE RAILWAY CONTAINER LOCKING SYSTEM

[75] Inventors: Hiroshi Toyota, Tokyo; Toshio Yamazaki, Omiya; Takashi Iketani, Yono, all of Japan

[73] Assignee: Japanese National Railways, Tokyo, Japan

[22] Filed: Mar. 25, 1975

[21] Appl. No.: 562,037

[30] Foreign Application Priority Data

Apr. 10, 1974 Japan ..... 49-39911

[52] U.S. Cl. ..... 105/366 C; 105/1 R; 105/311 R; 105/366 B; 105/366 D

[51] Int. Cl.[2] ..... B61D 17/00; B61D 49/00; B65J 1/22; H01R 33/00

[58] Field of Search ..... 105/1 R, 311 R, 366 D, 105/366 E, 366 B, 366 C, 366 R

[56] References Cited

UNITED STATES PATENTS

| | | | |
|---|---|---|---|
| 1,555,594 | 9/1925 | Macloskie | 105/311 R X |
| 3,072,074 | 1/1963 | Lunde et al. | 105/311 R X |
| 3,446,373 | 5/1969 | Keister, Jr. et al. | 105/311 R X |
| 3,507,225 | 4/1970 | Terlecky et al. | 105/366 D |
| 3,868,909 | 3/1975 | Pelabon | 105/1 R |

*Primary Examiner*—Robert J. Spar
*Assistant Examiner*—Howard Beltran
*Attorney, Agent, or Firm*—Wenderoth, Lind & Ponack

[57] ABSTRACT

A system for issuing instructional signals to individual cars of a train for causing actuation of a device such as a container locking device of the individual car. A plurality of instructional signal lines and a plurality of feedback lines extend through each car in a direction parallel to the direction of travel of the car, the number of lines being at least as great as the number of cars in the train. The one ends of the lines are connected to terminals at one end of each car in positional correspondence with the lines, and the other ends of the lines in each car are connected to terminals offset by one from the terminals in positional correspondence with the respective lines. The other end of the line on one edge of each array of the plurality of lines extends across the array and is connected to the terminal in positional correspondence with the line on the other edge of the array. The terminals in adjacent cars are connected. Instructional signal receiving relays in each car are coupled to the line on the one edge of each array, and the device for carrying out a desired function, such as locking of container in each car, is coupled to the instructional signal receiving relays for operation in response to energization of the relays. An order fulfilled signal transmitting relay in each car is coupled to the line on the one edge of each array and is actuated upon completion of the desired function. With this arrangement, the cars in the train can be shifted in the train or their direction reversed and the signal lines can still be used to transmit a signal to a given car in the train.

8 Claims, 25 Drawing Figures

1
2
3
4
5
E
SW1
SW2
SW3
SW4
L1
L2
L3
L4

1
2
3
4
5
E
SW1
SW2
SW3
SW4
L1
L2
L3
L4
6
7
8
9'
61
61'
71
71'
81
(+)

FIG. 4c
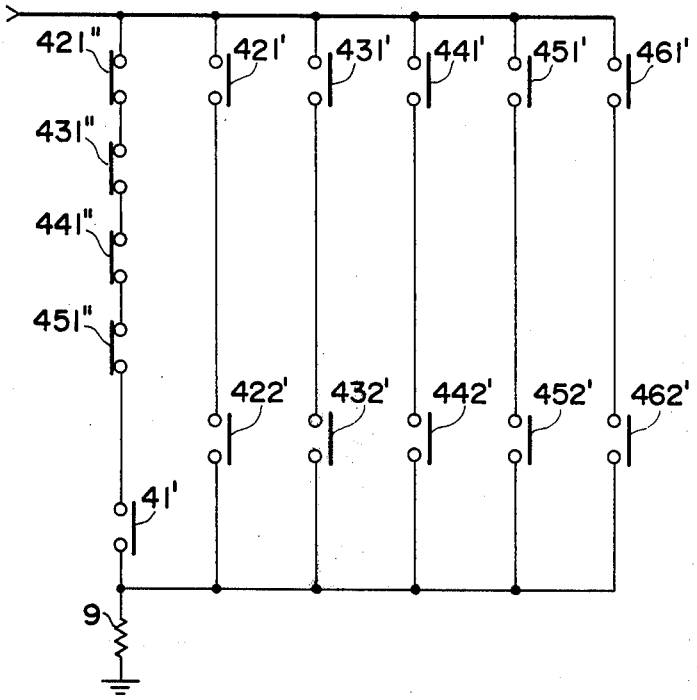
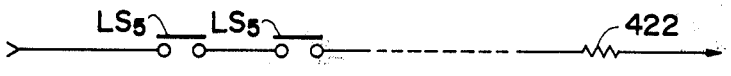
FIG. 4d
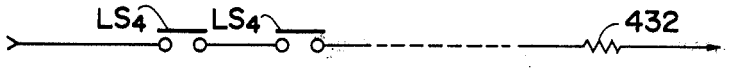
FIG. 4e
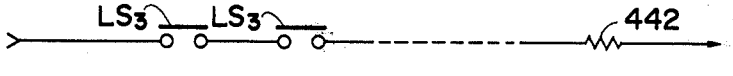
FIG. 4f
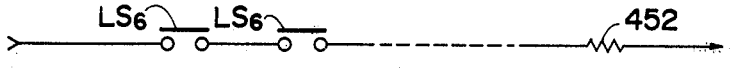
FIG. 4g
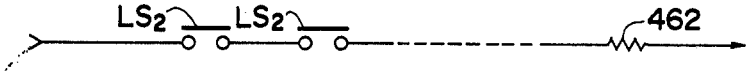
FIG. 4h

REMOTE RAILWAY CONTAINER LOCKING SYSTEM

FIELD OF THE INVENTION

The present invention relates to a system for transmitting an electrical instructional signal to an individual car in a train of cars by means of order lines and feedback lines running through all the cars of the train. More specifically, with the system of the present invention, an instructional signal is issued to a selected one from among many cars connected in an arbitrary sequence as a train from a dispatcher room located on the ground or aboard the foremost car or the rearmost car of said train, and when the car which has received the instructional signal performs the corresponding action, an order fulfilled signal is sent back to said dispatcher room, where it produces a display. In the present invention, even without a receiver on each car responding to only one specific frequency, transmission of signals between a selected car of a newly composed train and the dispatcher room can take place, regardless of any way in which the direction or relative position of the car in the train changes as the result of makeup, breakup or directional change of the train, or regardless of any transposition of cars, so that the present invention can successfully be applied to a train containing many cars which is frequently subjected to makeup, breakup or directional change.

BACKGROUND OF THE INVENTION

According to one prior art method of issuing an instructional signal to a selected one of the cars making up a train, a signal having a specific frequency is allocated to each car of the train; each car is equipped with a receiver which receives only the specific frequency signal allocated thereto; and an instructional signal at said specific frequency is transmitted to the selected car, thereby issuing an order to the car. According to another method, in which a basic condition is that a car maintains a fixed position in the train, an order line runs from the dispatcher car to a car to be sent an instructional signal and over this line an instructional signal is sent to the desired car.

In the former method, each car has to be equipped with a receiver which can receive only its specific assigned frequency signal; and, accordingly, when a train is composed of many cars, the installation and maintenance costs involved will be so high that it is practically impossible to adopt this method.

The latter method, which is based on the maintainance of the position of each car in a train, is virtually impossible to use for a train which is subjected very often to makeup, breakup, and directional change.

In view of these disadvantages of the conventional methods, the primary object of the present invention is to provide a system for issuing instructional signals to individual cars of a train which is often subjected to makeup, breakup or directional change, and by which system an instructional signal can be issued to any car in a newly madeup train, regardless of any change in the number of cars in the train, the direction of travel of the train, and the relative position of the car in the train.

Another object of the present invention is to provide an economical system for issuing instructional signals to individual cars of a train, especially one containing a large number of cars, with which system there is no need of equipping each car of the train with a receiver which receives a specific frequency signal allocated thereto; and, accordingly, the installation and maintenance costs can be greatly reduced.

SUMMARY OF THE INVENTION

These objects are achieved by the system of the present invention in which in each car of a train there are as many order lines and feedback lines as there are cars contained in the trains. These lines run parallel to the travel direction of the car. One end of each of the order lines and the feedback lines are successively connected to the positionally corresponding parallel terminals at one end of the car, while the other end is connected to a similar terminal at the other end of the car and offset from the terminal at the one end of the car by one position. For example, if the order lines and feedback lines in one car are parallel and spaced from each other in a vertical plane, then the topmost or bottommost order line and feedback line will have their one ends connected to the topmost or bottommost terminals and will have their other ends connected to the terminals corresponding, respectively, to the bottommost or topmost lines, and the remaining lines will all have their other ends connected to the terminal corresponding to the next higher or lower line. Thus, when all lines are linearly connected, said topmost and bottommost lines will run across all the other order and feedback lines, and then be connected to the appropriate terminals. The above-mentioned crosswise order line is connected to an instruction signal receiving relay, while the above-mentioned crosswise feedback line is connected to an instruction fulfilled signal transmitting relay. At the opposite ends of cars connected one after another in the direction of travel of the train, the positionally corresponding terminals in adjacent cars are electrically connected. When in the dispatcher room located on the ground or aboard the foremost or rearmost car of the train a specific order line is energized, the instruction signal receiving relay of the corresponding car acts and in consequence the desired action is performed at the car. Upon completion of the action, the order fulfilled signal transmitting relay on said car is actuated, sending an order fulfilled signal over the corresponding feedback line to the dispatcher room. In the present invention, preferably the group of order lines is provided on one side, with reference to the travel direction of the car, while the group of feedback lines is provided on the other side. In addition, in connection with the sending of an instructional signal to a car over an order line from the dispatcher room, it is desirable that the order fulfilled signal from the car be indicated on a display unit connected to each feedback line at the dispatcher room. In the application of the present invention to a container train composed of container carrying cars, such as is known in the prior art, it is desirable that upon reception of an instructional signal from the dispatcher room by the order receiving relay of the container carrying car, the container be locked in position or unlocked therefrom; and upon confirmation of the fulfillment of the order to lock or unlock, the order fulfilled signal transmitting relay on said car acts, sending the appropriate signal to the dispatcher room.

In the above case, for the purpose of fastening the container, it is desirable that a bar which is movable vertically, rotatable to a limited degree, and having an elongated head be employed, whereby magnets provided at specified positions around said bar and a limit switch of a type common in the prior art be provided at specified positions on the car to react to a displacement of said bar so that the amount of said displacement can be controlled by the closing and opening of said limit switch.

The other objects, features and advantages of the present invention will become apparent from the following detailed description taken in conjunction with the attached drawings.

BRIEF DESCRIPTION OF THE DRAWINGS

In the drawings:

FIG. 4*c* is a circuit diagram of the order fulfilled acknowledging means provided in each car;

FIG. 4*d* is a circuit diagram of means for acknowledging the completion of the loading of the container fastening bars in a car;

FIG. 4*e* is a circuit diagram of means for acknowledging the completion of rotation of the container fastening bars in a car;

FIG. 4*f* is a circuit diagram of means for acknowledging the completion of reversion of the container fastening bars in a car;

FIG. 4*g* is a circuit diagram of means for acknowledging the completion of a container unloading operation of a car;

FIG. 4*h* is a circuit diagram of means for acknowledging the completion of the downward displacement of the container fastening bars in a car;

DESCRIPTION OF THE PREFERRED EMBODIMENT

Figures 1A, 1B:
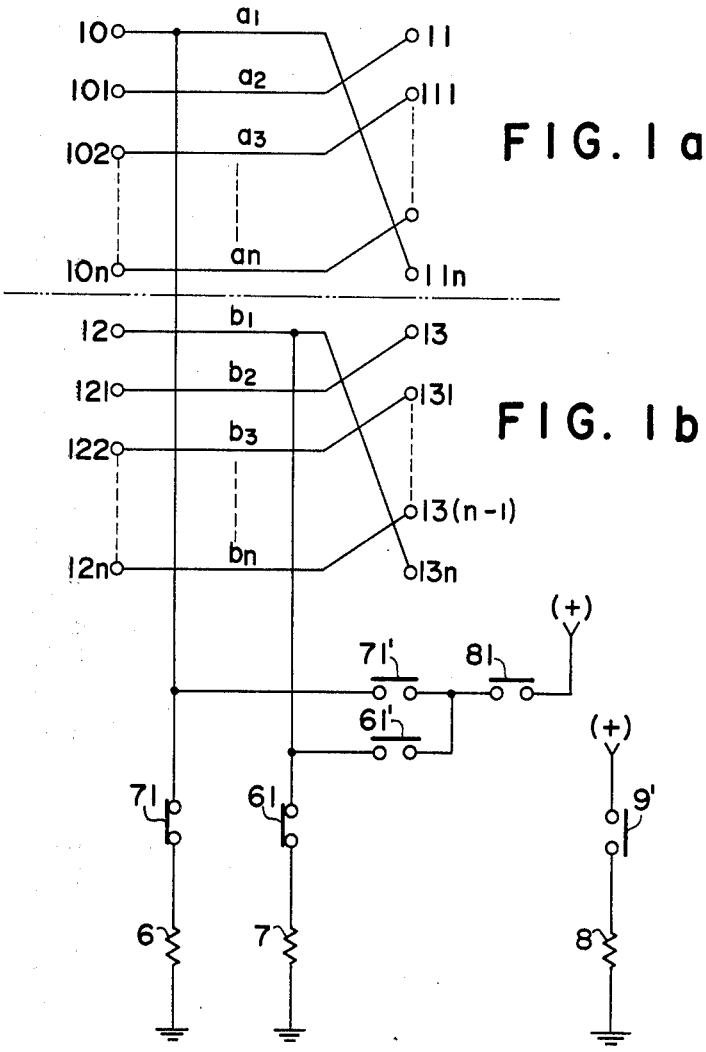
FIGS. 1*a* and 1*b* are circuit diagrams of the order receiving circuit and the order fulfilled signal transmitting circuit installed on a car to be controlled according to the system of the invention.

FIG. 1 illustrates an example of the instructional signal receiving circuit and the order fulfilled signal transmitting circuit mounted on each car which is to be controlled according to the present invention.

In FIG. 1, at least as many order lines $a_1$–$a_n$ as the number of cars composing a train are arranged in parallel in an array on one side of each car in the direction of travel. Since the number of cars in a train is not always the same, usually the number n of parallel order lines in the array corresponds to the greatest conceivable number of cars in a train. If the number of cars in a train is less than the number of order lines, only the number of order lines which corresponds to the actual number of cars in a train need be used.

The one ends of the order lines $a_1$–$a_n$ are, respectively, connected to the terminals 10, 101 . . . 10*n*, while the other ends are connected to the terninals 11, 111. . . 11*n*. However, it will be seen that the one ends are connected, respectively, to the positionally corresponding terminals 20, 101 . . . 10*n*, but the other ends are connected to respective terminals positionally offset from terminals 10, 101 . . . 10*n* by one. That is, in FIG. 1*a*, the line $a_2$ has the one end connected to the terminal 101 and has the other end connected to the terminal 11 at the topmost position; the third line $a_3$ has the one end connected to terminal 102 and the other end to the second terminal 111; and so on, the connections of the other ends being connected to terminals successively offset by one. The line $a_1$, at one edge of the array, here the topmost edge, has the one end connected to the terminal 10 and the other end connected to terminal 11*n* arranged at the edge of the array, here the bottommost terminal. The feedback lines $b_1$–$b_n$ are arranged on the opposite side of the car relative to the direction of travel. Just as in the arrangement of the order lines, the feedback lines are usually parallel and there are as many in the array as the greatest conceivable number of cars in a train. Further, just as is the case with the order lines $a_1$–$a_n$, the one ends of the feedback lines are connected to the positionally corresponding parallel terminals 12–12*n*, while the other ends are connected to the parallel terminals 13*n*, 13, 131 . . . 13(*n*-1), which are positionally offset by one from terminals 12–12*n*.

Thus, when all feedback lines $b_1$–$b_n$ are connected between the appropriate end terminals, the line $b_1$ will run across all the other feedback lines. The order line $a_1$ is connected to an instructional signal receiving relay 6 through a dropaway contact 71 of a hereinafter described instructional signal receiving relay 7, while the feedback line $b_1$ is connected to the instructional signal receiving relay 7 through a dropaway contact 61 of the instructional signal receiving relay 6. Relay 6 can also have other contacts which can be actuated when relay 6 is energized to operate various types of apparatus on the car. Branching off the circuit between the order line $a_1$ and the dropaway contact 71 is a series circuit for another pickup contact 71′ of the relay 7, a pickup contact 81 of a hereinafter described order fulfilled signal transmitting relay 8, and a (+) power source. Branching off the circuit between the pickup contact 71' and the pickup contact 81 is a circuit which is connected to the feedback line $b_1$ through a pickup contact 61' of the instructional signal receiving relay 6. In FIG. 1 there is also shown a circuit between the (+) power source and ground which has relay 8 in series with a pickup contact 9' of an action finished relay installed in each car which is energized when the action is finished.

Figure 2:
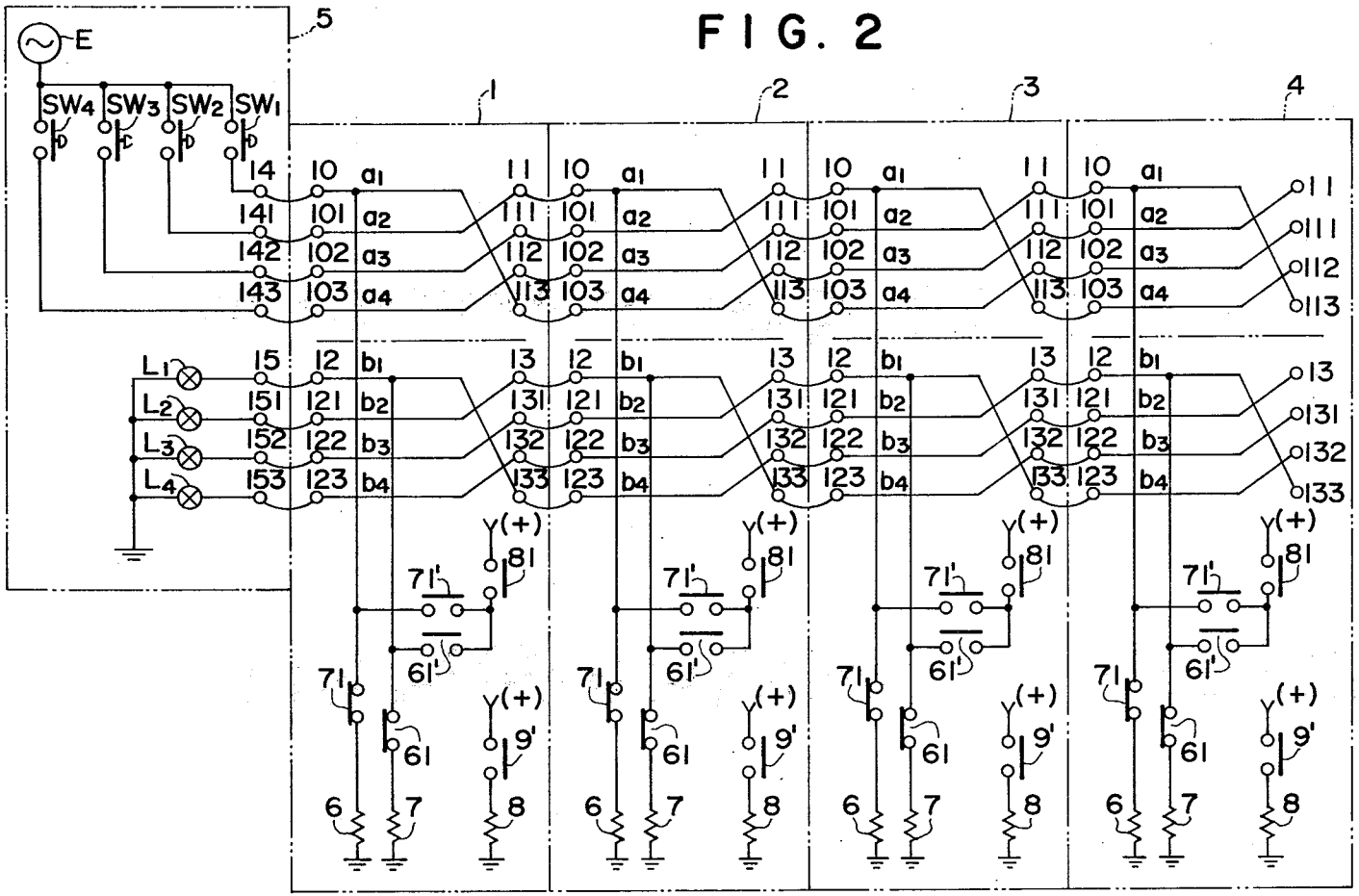
FIG. 2 is a circuit diagram of one embodiment of the present invention applied to a four-car train.

FIG. 2 shows a circuit diagram for a train with the cars 1–4 each equipped with the instructional signal receiving and order fulfilled signal transmitting circuits of FIGS. 1*a* and 1*b* coupled together. The opposed terminals of the order lines and feedback lines for the successive cars are electrically connected. A dispatcher room 5 is set up within the foremost car 1. In this case, the dispatcher room 5 is provided with the instructional signal transmitting circuit which is constituted by the voltage source E switches $SW_1$–$SW_4$, respectively connected via the terminals 14 – 143 to the appropriate terminals 10–103 of the order lines in the first car and with the order fulfilled signal display means which is constituted by the pilot lamps $L_1$–$L_4$, respectively, connected via their terminals 15–153 to the appropriate terminals 12–123 of the feedback lines in the first car.

The illustrated example is for an instructional signal transmission and reception in a four car train, wherein four order lines and four feedback lines corresponding to the number of cars in the train are provided in each car.

With such arrangement, when an instructional signal is to be issued to car 3, the dispatcher closes the switch $SW_3$ in the instructional signal transmitting circuit. Thereupon a voltage from the source E is imposed on the order line $a_3$ of the car 1, the order line $a_2$ of the car 2, and the order line $a_1$ of the car 3, causing the instructional signal receiving relay 6 of the car 3 to be energized. In consequence, an apparatus in the car 3 performs an action as instructed by the signal. Upon completion of the action by said apparatus, the action finished relay provided in the car 3 is energized to close the contact 9' energizing the order fulfilled signal transmitting relay 8. Thereupon the pickup contact 81 of said relay 8 closes. But since the instructional signal receiving relay 6 is still active, a voltage is imposed via the pickup contact 61' of said relay 6 on the feedback line $b_1$ in the car 3. The voltage imposed on said feedback line $b_1$ lights the pilot lamp $L_3$ of the order fulfilled signal display via the feedback line $b_2$ of the car 2 and the feedback line $b_3$ of the car 1. Thus, the dispatcher room 5 knows that the action in response to the instructional signal issued to the car 3 has been completed.

Similarly, when an instructional signal is to be issued to the car 4, the switch $SW_4$ in the dispatcher room 5 is closed. Thereupon the order goes over the line $a_1$ of the car 4, energizing the instructional signal receiving relay 6 of the car 4. The same sequence of actions occurs, and a signal is sent back over the feedback line $b_1$ of the car 4, the feedback line $b_2$ of the car 3, the feedback line $b_3$ of the car 2, and the feedback line $b_4$ of the car 1, and therefore the pilot lamp $L_4$ is lit.

Thus, in this embodiment wherein the same instructional signal receiving and order fulfilled signal transmitting mechanism as illustrated in FIG. 1 is provided on each car and the corresponding terminals of the cars coupled are connected, when the uppermost order line $a_1$ of the car is energized, the car 1 can be given an instructional signal from the dispatcher room. When the line $a_2$ is energized, the car 2 can be given an instructional signal. When the line $a_3$ is energized, car 3 can be given an instructional signal. And, when the line $a_4$ is energized, car 4 can be given an instructional signal. Meanwhile, the order fulfilled signal from the respective car lights the corresponding pilot lamp in the dispatcher room via the feedback lines through each car, thereby informing the dispatcher that the desired action has been finished. Since the arrangement is such that whatever the relative position of a car in the train, the same positional correspondence holds among the switches $SW_1$–$SW_4$, the cars 1–4 and the pilot lamps $L_1$–$L_4$, an instructional signal can always be issued to individual cars by the same system, however the number of cars in a train changes.

Figure 3:
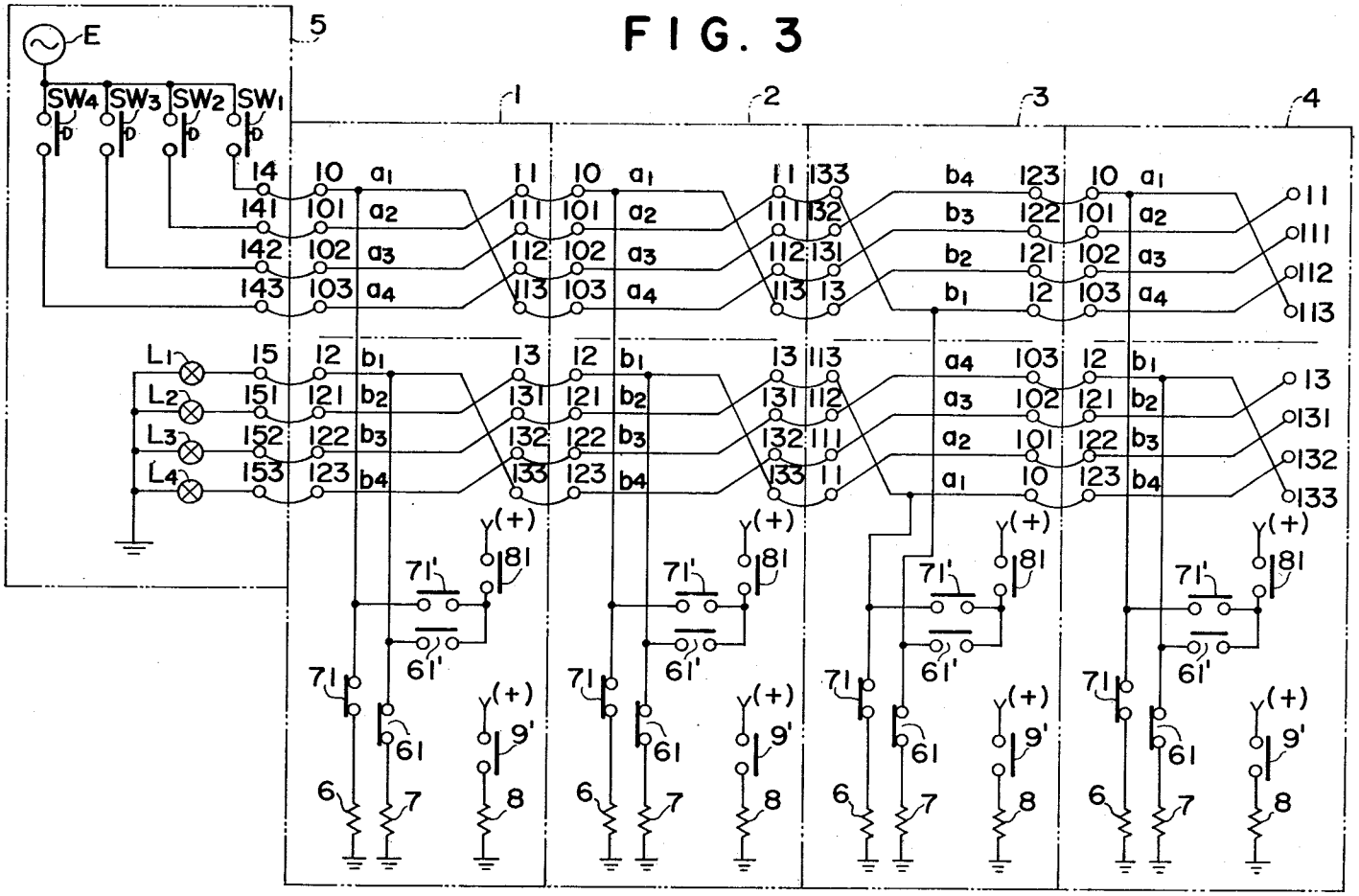
FIG. 3 is a circuit diagram of the embodiment of FIG. 2, where the third car is connected in the train, with the travel direction turned 180°.

FIG. 3 shows how the system according to the present invention operates, even when the direction of a car in a train is turned 180°.

In FIG. 3, the car 3 has had its direction changed by 180° as compared with its position in FIG. 2. Therefore, the disposition of the order lines $a_1$–$a_4$ and the feedback lines $b_1$–$b_4$ in that car is turned 180° from that of the same lines in the same car in the arrangement of FIG. 2. The effect of reversing the car can be achieved by turning FIGS. 1*a* and 1*b* upside down, so that in FIG. 1*a* the lines $a_1$–$a_n$ are on the right side of the car in the direction of travel, in the reversed position the lines $a_1$–$a_n$ will be on the left side. In this position they will be connected with the terminals of the feedback lines $b_1$–$b_n$ of the remaining cars and in the reverse positional order.

In this arrangement, when the car 3 is to be sent an instructional signal, the dispatcher switch $SW_3$ is closed. Then the line $b_1$ of the car 3 will be impressed with a voltage via the line $a_3$ of the car 1 and the line $a_2$ of the car 2 and in consequence the instructional signal receiving relay 7 in the car 3 will be energized. When, upon completion of the desired action in the car 3 the contact 9' in the car 3 is closed, the order fulfilled signal transmitting relay 8 is energized to close contact 81. Since the relay 7 is still in action and the contact 71' is closed, a voltage from the (+) source is imposed on the line $a_1$ of the car 3, on the line $b_2$ of the car 2, and on the line $b_3$ of the car 1 to light the pilot lamp $L_3$, which tells the dispatcher that the car 3 has completed the action according to the instructional signal given thereto. Transmission of an instructional signal to the car 4 and lighting of the pilot lamp $L_4$ confirming the completion of the desired action by the car 4 can take place by the closing of the switch $SW_4$ in just the same way as in the arrangement of FIG. 2. The same is true when any car other than the car 3 is turned 180°, as well as when all the cars are turned 180° from the positions in FIG. 2.

With the arrangement of FIG. 2, the order from the dispatcher to all cars invariably goes to instructional signal receiving relay 6, and through the action of the order fulfilled signal transmitting relay 8 the order fulfilled signal goes via the contact 61 to the dispatcher. But, in a car turned 180° as compared with the car shown in FIG. 2, the order is given to the instructional signal receiving relay 7 and upon completion of the desired action, the order fulfilled signal goes via the contact 71' to the dispatcher. Otherwise, the operation is just the same as for the FIG. 2 arrangement.

FIG. 4*a* – FIG. 7 illustrate the manner of applying the present invention to a conventional container train for the purpose of automatically locking or unlocking a container on the train by means of an instructional signal from the dispatcher room. In the following description, the locking of the container to and unlocking of the container from the train are done automatically with the aid of a so-called twist fastening device of the prior art.

Figure 5A:
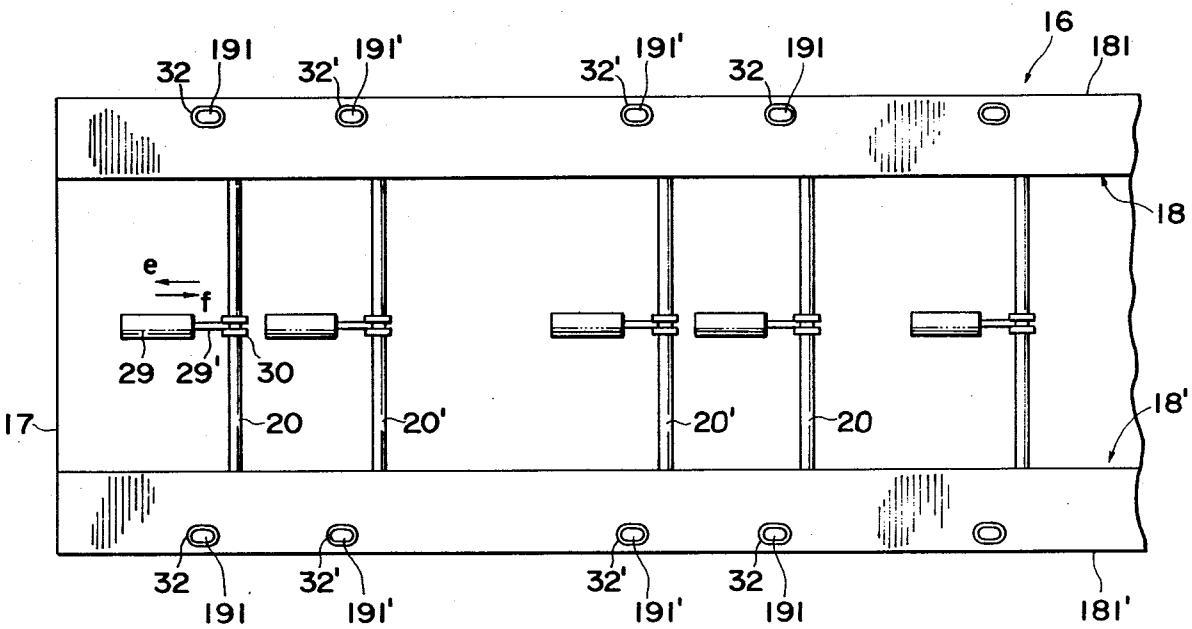
FIG. 5*a* is a plan view of a container car for use with the system of the present invention.
Figure 5B:
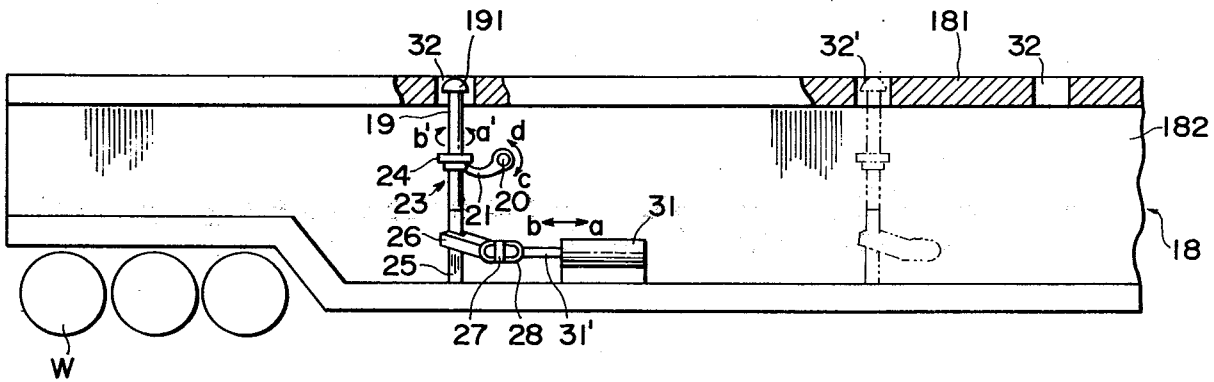
FIG. 5*b* is a side view, partly in section, of the car of FIG. 5*a;*

As illustrated in FIGS. 5*a* and 5*b*, the conventional container car 16 consists of parallel I beams 18 and 18' having the same dimensions, one on each side of the truck frame 17 and extending in the direction of travel of the car. The I beams are spaced such that when a container is mounted on them, the four bottom corners of the container fit, respectively, along the edges of the flanges of the I beams. On the outside of the top flanges 181 and 181' of said I beams 18 and 18' are provided holes 32 for container fastening bars 19, respectively, matching the positions of fastening holes 161 in head receiving recesses 261 provided at the four corners of the container bottom, as illustrated in FIG. 5*c*. For each hole 32 there is provided a container fastening bar 19 which can be vertically displaced and rotated through a specified angle.

Figure 5E:
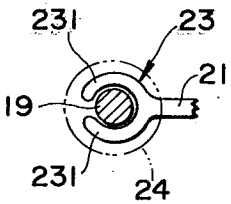
FIG. 5*e* is a plan view, partly in section, of the U-shaped metal part in FIG. 5*b;*
Figure 5C:
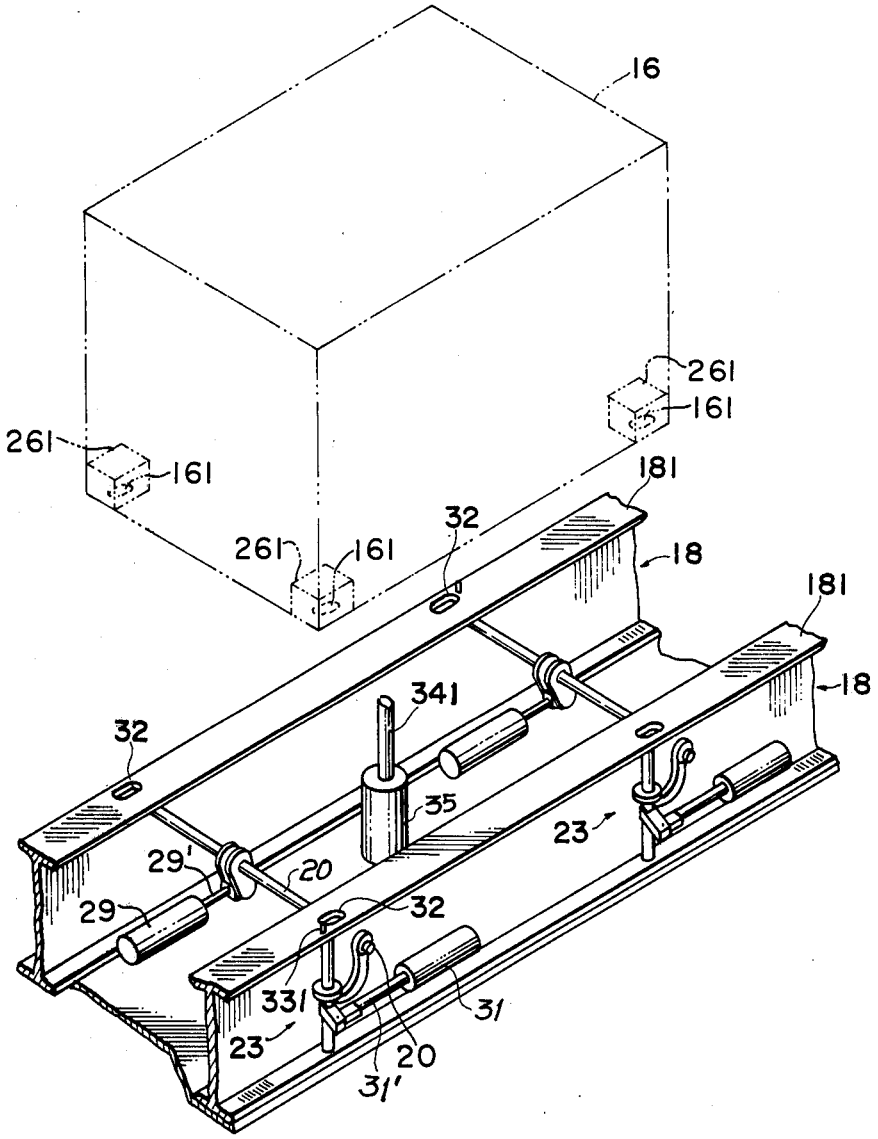
FIG. 5*c* is a perspective view showing details of the positional relation of the frame members of the car, the connecting rod and the cylinder rod shown in FIGS. 5*a* and 5*b;*

As seen from FIGS. 5*b* – 5*g*, the container fastening bar 19 has at the top a centrally raised flat or rectangular head 191. At a specified position along the container fastening bar 19 is a flange 24 and, as seen in FIG. 5*e*, a U-shape metal fork 23 has two hook shaped portions 231 extending around bar 19 and engaging the bottom of said flange 24, the hook portions 231 being integrally connected by a shank 21 to a connecting rod 20 on which shank 21 is rigidly secured. Said connecting rod 20 is rotatable in both directions *c* and *d* around the axis of the connecting rod 20 as the center, said connecting rod 20 extending between the opposed I beams with the ends thereof protruding outside the beams through holes in the web members 182. A piston cylinder mechanism 29 is provided between I beams 18 for each rod 20 and the piston rod 29' thereof is coupled to rod 20 by a crank arm 30 rigidly mounted on the rod 20. The portion 25 of bar 19 below the portion upon which said flange is located has a rectangular cross section, and said lower portion 25 fits into a hole formed at the end of the connecting member 26. The other end of said connecting member 26 is pinned at 27 to a corresponding slot, on the left in FIG. 5*b*, of a connecting member 28. At the other end of the connecting member 28 is fixed the outer end of a rod 31' of a piston cylinder means 31. The container fastening bar 19 is vertically movable, while the connecting member 26 is still, while axial rotation of bar 19 can take place during simultaneous rotation of the connecting member 26.

An identical container fastening bar 19 is installed at the other end of the connecting rod 20. A pair of such connecting rods 20 with container fastening bars 19 coupled to both ends thereof is, as shown in FIG. 5*a*, positioned at specified intervals in the longitudinal direction of the car. Thus, there are, as indicated in FIG. 5*a*, four container fastening bars 19 corresponding to the four fastening holes 161 in the bottom of a container to fasten one container.

There are also provided on the car fastening holes 32' and corresponding container fastening bars having heads 191', as shown in FIG. 5*a*, which are identical with the above-described fastening holes 32 and container fastening bars 19, but the spacing of the latter container fastening bars along the car is smaller than that of the bars 19. Containers are designed in several different sizes, depending on the type of load to be transported, and while the width of the various containers is usually the same, the length in the longitudinal direction is varied. FIG. 5*a* illustrates a car which can carry two types of containers, a type A for which holes 32 and bars 18 are appropriately spaced, and type B for which holes 32' are appropriately spaced.

The container fastening holes 161 provided at the four corners of a container each have the same shape as the head 191 of the above-described container fastening bar 19, but the hole 161 is slightly larger than the head 191.

In a specific embodiment in which the system of the invention is used, container fastening bars as described above are provided at positions corresponding to four corner positions of a container on the cars 1–4 in FIG. 2. The manner in which a container of type A is fastened in the appropriate position on, for example car 1, will be described in connection with FIG. 2 and FIG. 4*a* to FIG. 7.

Figure 4A:
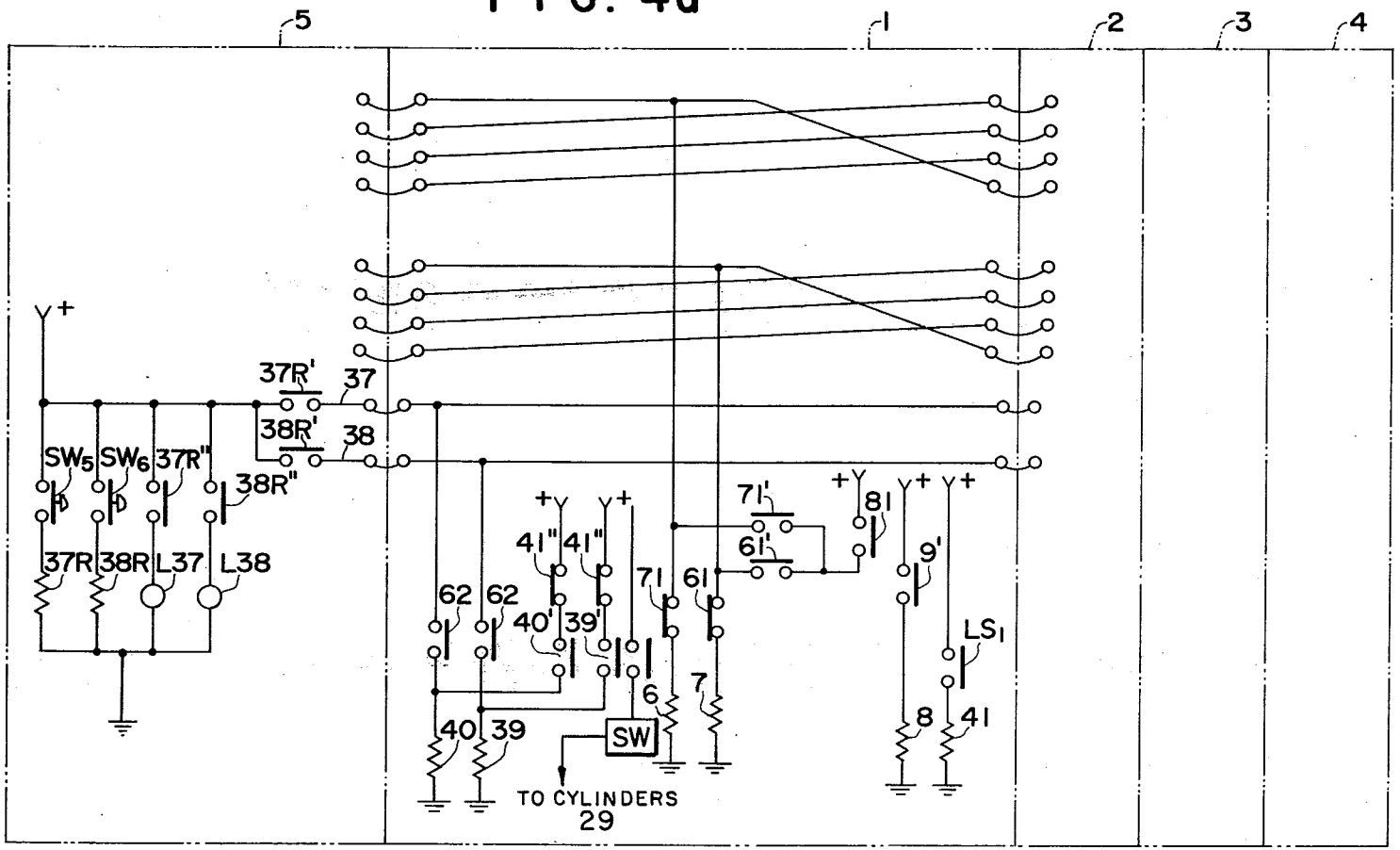
FIG. 4*a* is a circuit diagram of a container type indicating line.

For the purpose of indicating the type of a container to be fastened to the car 1 and causing the container fastening bars on said car to project above the surface of the top flange of the I beams of said car so as to be ready for a fastening action, container type indicating lines 37 and 38, as shown in FIG. 4*a* and the circuits as shown in FIG. 2 will be required.

In FIG. 4*a*, the line 37 is the type A container indicating line and 38 is the type B container indicating line. The container indicating lines 37 and 38 extend in parallel through all the cars and are connected between cars by terminals, and container type information receiving relays 40 and 39 in each car are connected to these lines through contacts 62 of the order receiving relay 6 of FIG. 2 provided in that car. In FIG. 4*a*, $SW_5$ and $SW_6$ are container type indicating switches provided in the dispatcher room 5.

Figure 5D:
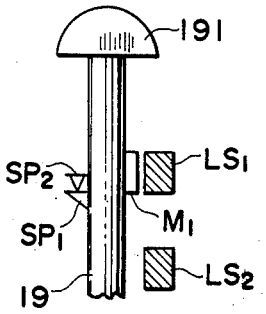
FIG. 5*d* is an elevation view, on an enlarged scale, of the container fastening bar.
Figure 5J:
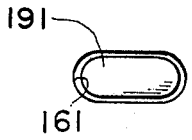
FIG. 5*j* is a plan view of a container-fastening bar which has been displaced upwardly through a hole provided in a container bottom.

With this arrangement, when the switch $SW_1$, as shown in FIG. 2 and the switch $SW_5$ as shown in FIG. 4*a* are closed, an instructional signal to raise the type A container fastening bars 19 is issued to the car 1. The closing of $SW_1$ energizes the instructional signal receiving relay 6 of the car 1 in FIG. 2, and the closing of $SW_5$ energizes the relay 37R in FIG. 4*a*, whereupon the pickup contact 62 of the relay 6 closes, and the pickup contact 37R' of the relay 37R closes, thus energizing the relay 40 of the car 1. Energizing of relay 37R also closes the pickup contact 37R'', causing the type A container fastening bar lift order lamp $L_{37}$ to go on. Energizing of relay 40 closes the pickup contact 40' of the relay 40, so that the type A container information receiving relay 40 is kept energized. This closes a further switch SW, such as a magnetically actuated pneumatic valve or hydraulic valve, to actuate the cylinders 29 to control the flow of actuating fluid to the piston cylinder mechanism 29 to move the rods 29' in the direction of the arrows *e* in FIG. 5*a*. Movement of the rod 29' of the piston cylinder mechanism 29 in the direction of arrow *e* causes the connecting rod 20 to rotate in the direction *c*. Thereupon U-shape metal fork 23 turns around the axis of the connecting rod 20 in the direction *c*, thereby causing an upward displacement of flange 24, so that the container fastening bars 19 are displaced and the heads 191 of the container fastening bars 19 pass through the corresponding holes 32. As illustrated in FIG. 5*d*, a magnet $M_1$ is provided on each container fastening bar 19, and a conventional limit switch $LS_1$ is provided adjacent said container fastening bar 19 at the uppermost position of the magnet $M_1$, and when said magnet $M_1$ moves adjacent said limit switch $LS_1$, at which position the head 191 of the container fastening bar 19 protrudes out of said hole 32 to a specified height above the upper flange 181 of said I beam, then the end of the upward displacement of the head 191 will cause a closing of the switch $LS_1$, and this will energize the relay 41 in FIG. 4*a*. This closes a contact 41', as shown in FIG. 4*c*, and since the contacts 421'', 431'', 441'', 451'' are closed, the relay 9 is energized. This, in turn, closes the contact 9' of the car 1, as shown in FIGS. 2 and 4*a*, which, in the manner described hereinbefore, lights the pilot lamp $L_1$ in the dispatcher room 5. Thus, the raising of the type A container fastening bars of the car 1 to the specific height is confirmed. At the same time, energizing of the relay 41 causes the opening of the dropaway contact 41'', and the self-holding circuit for the relay 40 in FIG. 4*a* is broken, whereby movement of the rod 291 of the cylinder 29 stops.

In this case, despendng on necessity, as indicated in FIG. 5*d*, a projection $SP_1$ is provided at a specified position around the container fastening bar 19 and a projection $SP_2$ is provided adjacent to said container fastening bar. When the container fastening bar is at the lowerst position, the magnet $M_1$ is located in opposition to the limit switch $LS_2$. When $SP_1$ hit $SP_2$, the vertical movement of the bar is mechanically stopped with the magnet $M_1$ opposed to the limit switch $LS_1$.

When the car 1 is equipped with two sets of container fastening bars for the purpose of carrying, for example, two type A containers thereon, the cylinders 29 for the various rods 20 have only to be connected in parallel to relay 40 so that they can act at the same time to move the rods 29' in the same direction the same distance; and the relay 41 has only to be series connected to the lead switches $LS_1$ provided adjacent the two sets of fastening bars, so that the relay 41 will act upon the closing of all of these switches. In this way, only when all the fastening bars in the car 1 have moved up a specified height will the pilot lamp $L_1$ in FIG. 2, go on. If the cars 2, 3, etc. are designed in the same way as the car 1, to carry type A containers, the energizing of the type A container order line 37 in FIG. 4*a* and closing of the switches $SW_2$ and $SW_3$, respectively, in FIG. 2, will, in the same manner as in car 1, cause the fastening bars 19 in these cars to rise to a specific height, and the lamps $L_2$, $L_3$, etc. in FIG. 2 to go on.

When the car 4 is so arranged that it can carry type B containers, then the switch $SW_4$ in FIG. 2 and the switch $SW_6$ in FIG. 4*a* in the dispatcher room 5 are closed. Thereupon, in the same manner as described above, the order receiving relay 6 and the relay 39 in the car 4 are energized, and in this case the pilot lamp L tainer fastening bars 19' have risen to the specific height in the car 4.

Figure 4B:
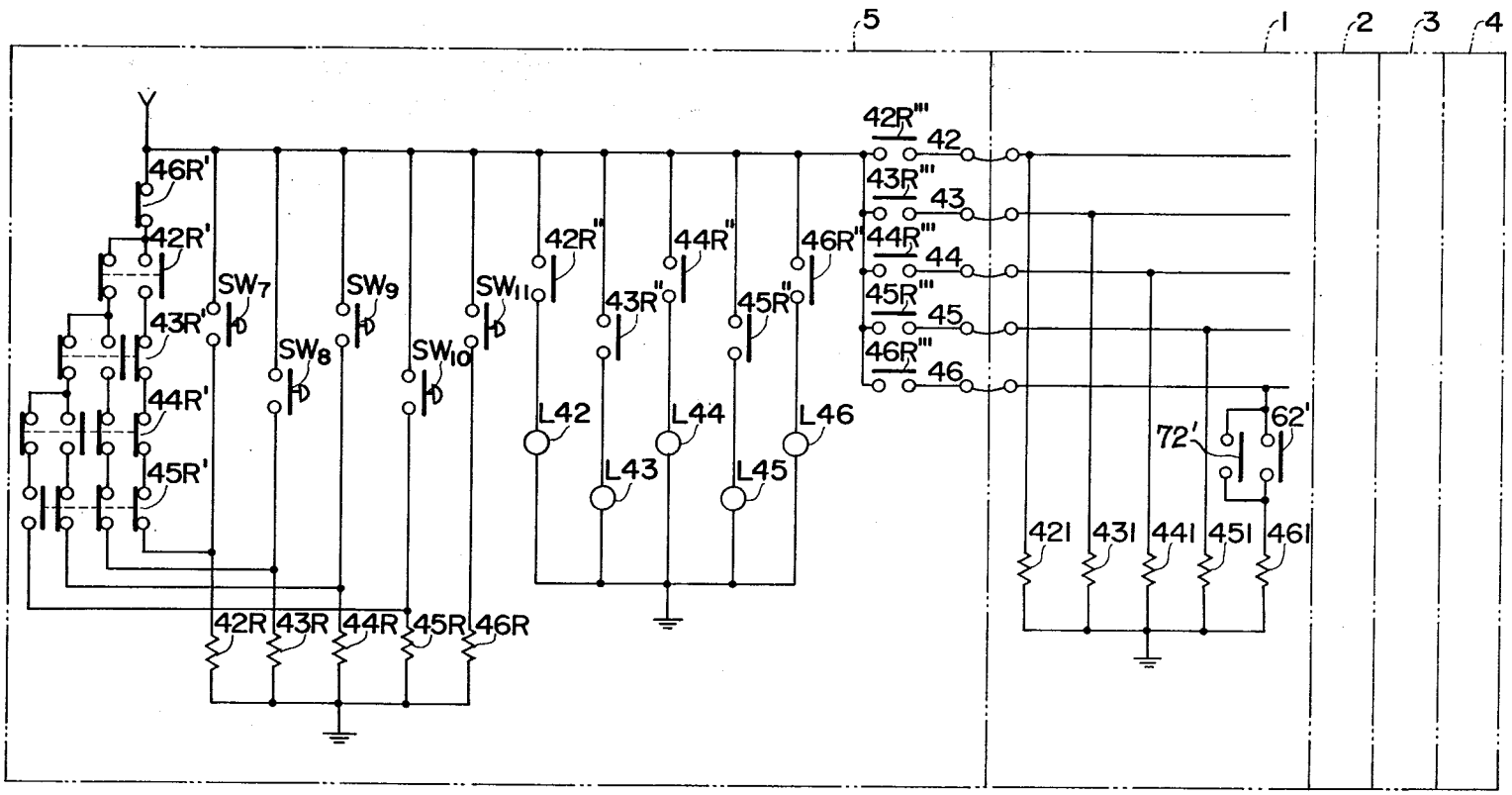
FIG. 4*b* is a circuit diagram for carrying out automatic operation of the locking and unlocking mechanism for a container.

Subsequent operations for carrying out automatic locking of the containers to the cars by means of the fastening bars is carried out by the use of the circuit of FIG. 2 and the circuits of FIGS. 4*b* and 4*c*.

The circuit of FIG. 4*b* is a circuit having a plurality of parallel lines 42–46 running through all the cars, the part of it within the dotted line 5 at the left extreme being located in the dispatcher room 5, and the parts of it within the dotted lines 1–4 being located in the cars 1–4. The line 42 is a line for confirmation of the fact that the containers have been loaded onto the cars, the line 43 is a line for transmitting an instructional signal for rotating the fastening bars, the line 44 is a line for transmitting an instructional signal for reverse rotation of the fastening bars, the line 45 is a line for confirmation of the fact that the cars are empty, and the line 46 is a line for transmitting an instructional signal for downward displacement of the fastening bars. FIG. 4c shows an order fulfilled acknowledge circuit provided in each car.

Let it be assumed that the lamps $L_1$–$L_4$ in FIG. 2 indicate that all the fastening bars in all cars of a train have been appropriately displaced upwardly. At this stage, the relay 9 in FIGS. 2 and 4c is energized by the closed contact 41' of the relay 41.

Figure 6:
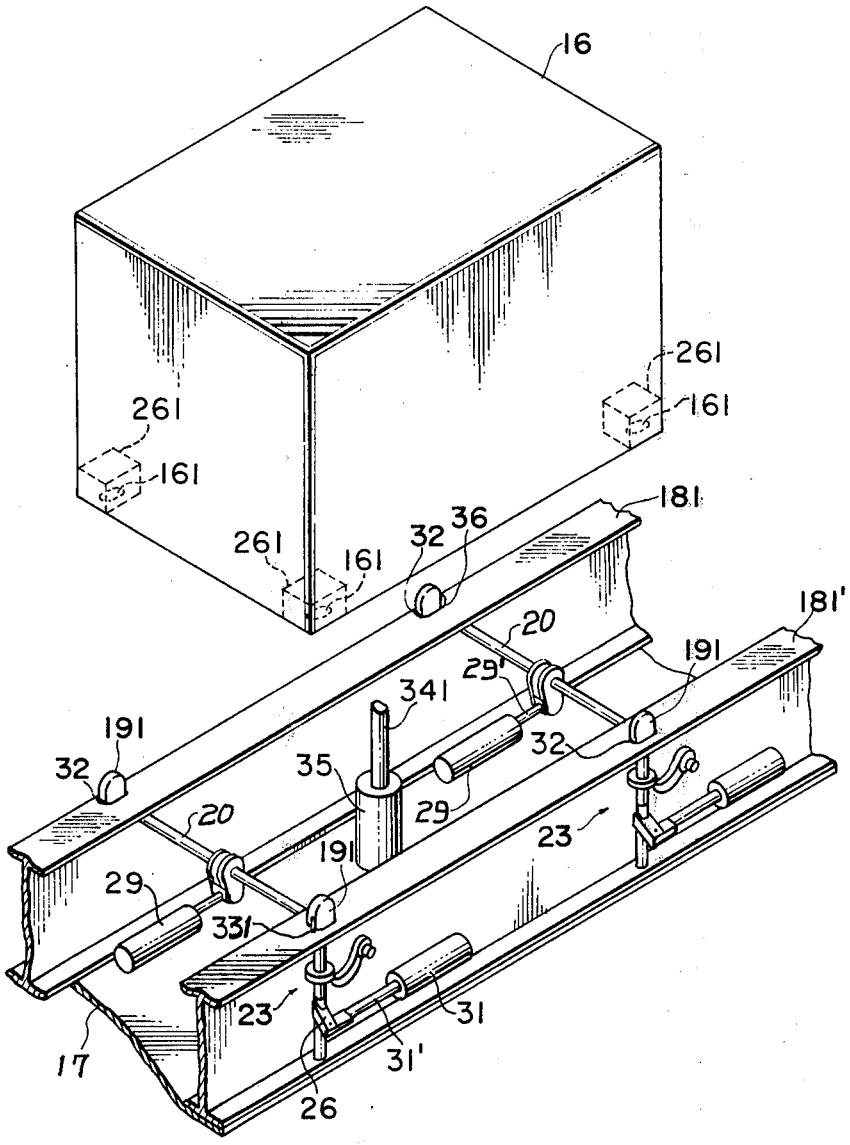
FIG. 6 is a perspective view of a container car ready for loading of a container thereon.
Figure 7:
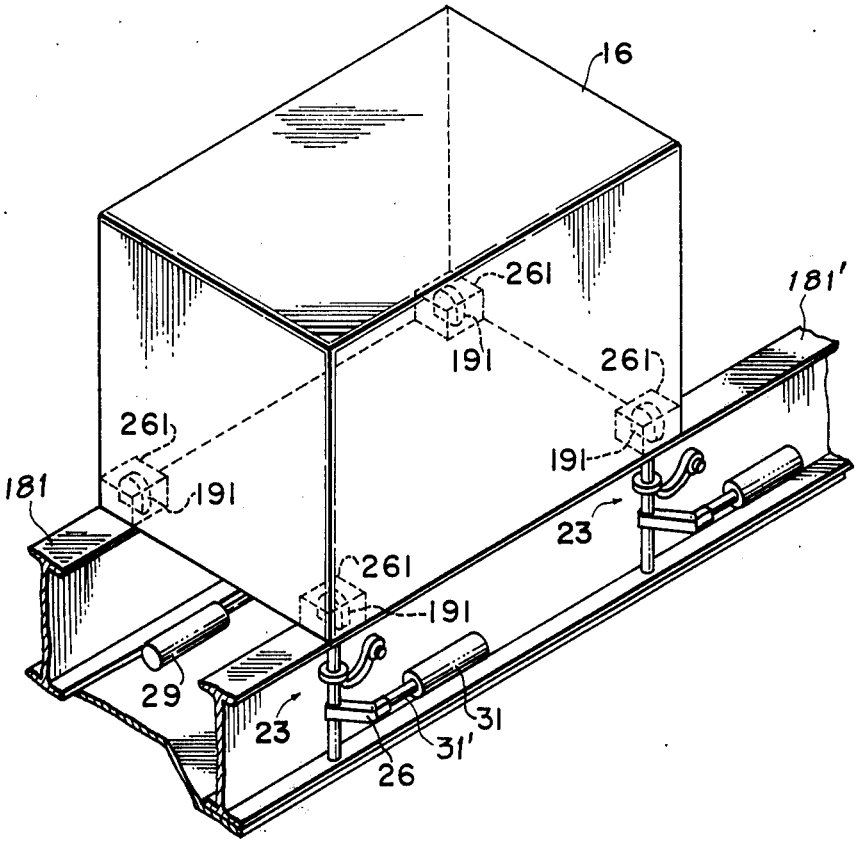
FIG. 7 is a perspective view of the car of FIG. 6 after a container has been loaded thereon.

Next, for the purpose of loading a container onto each car, the load order switch $SW_7$ of FIG. 4b is closed. Thereupon, the load order relay 42R is energized and is held ON by the closing of the pickup contact 42R' of the relay 42R. At the same time, the closing of the pickup contacts 42R'' and 42R''' by the relay 42R causes the loaded order lamp $L_{42}$ to go on, and the line 42 to be energized to energize the relay 421 in each car for issuing the load order. At the same time, the contact 421'' of said relay 421 in the circuit of FIG. 4*c* provided in each car is opened, the relay 9 is deenergized, the pilot lamps $L_1$–$L_4$ in FIG. 2 go off, and the contact 421' in FIG. 4*c* is closed. Thus, each car is in the condition as indicated in FIG. 6, i.e. ready for loading containers.

Figure 5K:
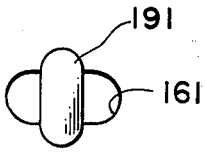
FIG. 5*k* is a plan view of a container fastening bar which has been rotated from the position shown in FIG. 5*j;*
Figure 5I:
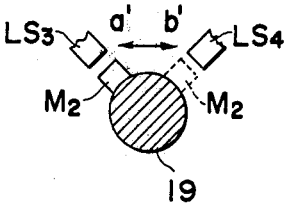
FIG. 5*i* is a section showing details of the means for rotation of the container fastening bar.
Figure 5F:
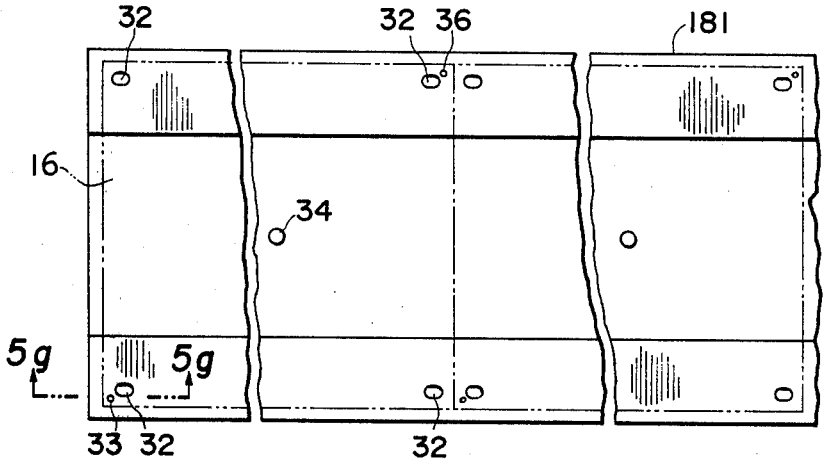
FIG. 5*f* is a plan view of container cars where the positional relation of the holes for the container fastening bars and the actuating member for acknowledgement of container loading is shown.
Figure 5G:
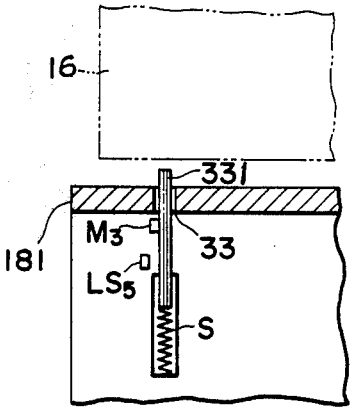
FIG. 5*g* is a section taken on line 5*g*—5*g* of FIG. 5*f;*

For the purpose of confirming that the containers have been properly loaded in the specified positions, in the present embodiment and acknowledge mechanism as illustrated in FIGS. 5*f* and 5*g* is employed.

As shown in FIGS. 5f and 5g, a container loaded acknowledge mechanism is installed at two diagonal corners 33 and 36 of each type A container position and at the center 34 of each container position. Each corner mechanism has an actuating rod 331 which is pushed down by the corresponding bottom of a container only when the holes 161 in the container bottom fit properly around said container fastening bars 19. Said actuating rods 331 of the corner mechanisms are vertically displaceable through holes through the upper flange 181 of the I beams 18. Normally the upper parts of these rods protrude above the corresponding surface of the upper flange under the action of a spring S. However, when the container is in position, that is, when the appropriate holes 161 in the container bottom fit over the container fastening bars 19, said actuating rods are forced downwardly, the weight of the container overcoming the force of the spring S, thereby moving magnets $M_3$ on the rods 331 adjacent the limit switches $LS_5$ provided on I beams adjacent the rods 331 and in consequence causing said limit switches $LS_5$ to be closed. In the present embodiment said actuating rods 331 are provided only in the vicinity of the type A container fastening bars 19, and not in the vicinity of the bars 19' for the type B containers, which are smaller than the type A containers.

Therefore, even if a limit switch $LS_5$ is open on a car to which a type A container load order has been issued, it is not certain whether said car is empty or whether it has been loaded with type B containers. To make certain of this, an actuating rod 341 is provided at the center 34 of container loading position. Said actuating rod 341 is slidable into a cylinder 35 of a hydraulic piston cylinder mechanism. The relative position of the magnet $M_4$ on said actuating rod 341 and the limit switch $LS_6$ adjacent thereto is such that when the upward displacement of said actuating rod 341 is stopped by the bottom of a container loaded in position, the two are not adjacent each other, and when no container is in position, said actuating rod 341 is displaced to the topmost level where magnet $M_4$ is adjacent limit switch $LS_6$ to close switch $LS_6$. Thus the car is known to be empty when said switch $LS_6$ is closed.

When all the container loading positions on, say, car 1, are properly filled with type A containers, all the limit switches $LS_5$ in the car 1 will close to energize the load acknowledge relay 422 connected in a series circuit of these limit switches, as shown in FIG. 4*d*, whereby contact 422' in FIG. 4c is closed to energize the relay 9 provided in car 1, causing the pilot lamp $L_1$ in FIG. 2 to go on. Thus, the lighting of the lamps $L_{42}$ and $L_1$ indicates that the loading of the car 1 with A type containers has been completed. Similarly, when the loading of cars other than car 1 is completed, the relay 9 provided in each car acts to light the appropriate pilot lamp $L_2$, $L_3$, or $L_4$ in the dispatcher room.

Next, to lock the containers to the cars, the switch $SW_8$ in FIG. 4b is closed, and a fastening bar rotating order relay 43R is energized to close the pickup contact 43R' of the relay 43R to hold the relay 43R energized. At the same time the pickup contacts 43R'' and 43R''' are closed to light the fastening bar rotate order lamp L43 and energizes the fastening bar rotate line 43, respectively, while at the same time the opening of the dropaway contact 43R' of the relay 43 deenergizes the holding circuit for relay 42R, thus opening switch 42R''' and deenergizing relay 421. Upon energization of the fastening bar rotate order line 43, the relay 431, as shown in FIG. 4*b*, provided in each car is energized. The contact 431'' of the relay 431 opens to keep the relay 9 deenergized, and in consequence the pilot lamps $L_1$–$L_4$ in FIG. 2 go off. On the other hand, the contact 431' closes and remains closed pending completion of the rotation of the fastening bar 19. In the present embodiment, the rotation of the fastening bars takes place in the manner as explained in connection with FIGS. 5*b*, 5*d* and 5*i*. The action of the relay 431 of, say, the car 1, actuates piston cylinder mechanism 31 to move the rod 31' in FIG. 5*b* in the direction *b*. Thereupon the fastening bar 19 turns around its axis in the direction of arrow *b'*.

As shown in FIG. 5i, a magnet $M_2$ is provided at a specified position of the outside of the fastening bar 19 and in the position illustrated in FIG. 5i, said magnet $M_2$ is opposite a limit switch $Ls_3$, and when bar 19 is turned in the direction *b'*, say, by 90°, said magnet comes opposite the limit switch $LS_4$, said magnet $M_2$ closing said limit switch $LS_4$. Closing of limit switch $LS_4$ deactuates piston cylinder mechanism 31 stopping the forward movement of the rod 31', so that fastening bar 19 has been automatically turned 90° from the position illustrated in FIG. 5*j* by the action of the piston cylinder mechanism 31. Then, as illustrated in FIG. 5*k*, the elongated top 191 on the fastening bar 19, now extending transversely of hole 161, will overlap the edges of the hole 161 provided in the container bottom and the container will be locked to the car 1 by said fastening bar 19.

In this case, though not shown, a projection, say $SP_3$ similar to the projection $SP_1$ illustrated in FIG. 5*d* may be provided at a specified position around the container fastening bar 19, while two projections, say $SP_4$, $SP_5$ are provided adjacent to the container fastening bar 19. Thus the rotation of the container fastening bar to a specific angle is mechanically so restricted that when said projection $SP_3$ hit, $SP_4$, the magnet $M_2$ may opposed the limit switch $LS_3$, and the container fastening bar is rotated, say, 90°, the projection $SP_3$ may hit $SP_5$, thereby bring the magnet $M_2$ into opposition to the limit switch $LS_4$.

A remainder of the piston cylinder mechanisms 31 provided on the car 1 is simultaneously driven from the relay 431, and when all the limit switches $LS_4$ are closed, a relay 432, to which said limit switches $LS_4$ are series connected, as shown in FIG. 4*e*, is energized. A contact 432' in FIG. 4c is closed, thereby to energize the relay 9, whereupon the pilot $L_1$ in FIG. 2 goes on. Lighting of the lamps $L_{43}$ and $L_1$ indicates that the fastening bars in the car 1 have completed their rotation. In other words, all the containers on the car 1 have been locked in position.

The same operation takes place with cars 2, 3 and 4, and lighting of the lamps $L_2$, $L_3$, and $L_4$ in FIG. 2 indicates completion of the rotation of the fastening bars.

With all the containers on all cars thus locked to the cars, the train is ready to depart. The dispatcher room 5 can also be on the ground beside the track. In that event, the dispatcher room can be electrically disconnected from the train, and thereafter the train departs.

When the containers are to be unlocked after the train reaches its destination, the dispatcher room 5 is reconnected to the train, if necessary, and the switch $SW_9$ in FIG. 4*b* is closed to energize the bar revert order line 44, whereupon the relay 44R is energized and held ON by the closing of the pickup contact 44R' of the relay 44R. The closing of the pickup contacts 44R'' and 44R''' of the relay 44R cause the bar revert order lamp $L_{44}$ to go on, and the bar revert order line 44 to be energized. Energization of the bar revert order line 44 energizes the relay 441 and opening of the contact 441'' in FIG. 4c causes deenergization of the relay 9. On the other hand, the contact 441' in FIG. 4*c* closes. Energizing of the relay 441 actuates piston cylinder mechanisms 31 to withdraw the rods 31' in the direction of arrow *a* in FIG. 5*b*, and, in the opposite manner to the turning of the fastening bars, the fastening bars turn in the direction of arrow *a'*. When the magnets $M_2$ come opposite the limit switches $LS_3$, the switches $LS_3$ close, and the withdrawl of the rods 31' is stopped. When all the limit switches $LS_3$ in car 1 are closed, the relay 442 in FIG. 4*f*, which is connected to the series circuit of these switches, is energized to close the contact 442' in FIG. 4c, thereby energizing the relay 9 and lighting the lamp $L_1$ in the dispatcher room 5.

In cars 2, 3 and 4 too, completion of the reverse movement of the fastening bars 19 causes the lamps $L_2$, $L_3$, and $L_4$ in the dispatcher room 5 to light.

After completion of unloading of the containers from each car, the switch $SW_{10}$ in FIG. 4b is closed to energize the empty car inform relay 45. The empty car inform relay 45 is held ON by the closing of the pickup contact 45R' of the relay 45.

Figure 5H:
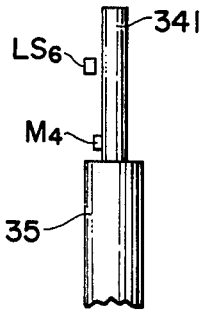
FIG. 5*h* is an elevation view of the actuating member for acknowledging completion of container unloading.

The energizing of relay 45R closes the pickup contacts 45R'' and 45R''' to light empty car indicate lamp L45 and to energize the empty car inform line 45. The dropaway contact 45R' of the relay 45 is opened to deenergize the bar revert order line 44. Energizing line 45 energizes the relay 451. Energizing of the relay 451 opens contact 451'' in FIG. 4c, thereby deenergizing the relay 9 in FIG. 4c, and at the same time closes the contact 451'. Energizing of the relay 451 causes the piston cylinder mechanism 35 provided in each car, as shown in FIG. 5h, to operate to displace the rods 341 thereof upwardly. If all the containers have been unloaded from the car 1, all limit switches $LS_6$ in the car 1, as shown in FIG. 5h, are closed by magnets $M_4$ to energize the relay 452 shown in FIG. 4g, which is connected to the series circuit of these switches. Upon closing of the contact 452' of the relay 452 in FIG. 4c, the relay 9 is energized to light the lamp $L_1$ in FIG. 2. Likewise, in cars 2, 3 and 4, completion of container unloading causes lighting of the lamps $L_2$, $L_3$ and $L_4$.

With a car in this condition, if it is desired to change the type of containers to be carried on any car or cars in the train and make up a new container train, it is necessary to lower the container fastening bars in that car or cars. A bar down relay 461 provided in each car is connected via a pickup contact 62' of the order receiving relay 6 in the car to the bar down order line 46 running through all the cars of the train. To change the type of container to be carried on the car 1, the switches $SW_1$ and a bar down order switch $SW_{11}$ provided in the dispatcher room 5 are closed to issue the bar down order to the car 1. The pressing of the bar down order switch $S_{11}$ energizes the bar down order relay 46R closing the pickup contact 46R'' to light the bar down lamp $L_{46}$, and closing the pickup contact 46R''' to energize the bar down order line 46. The dropaway contact 46R' of said relay 46 is opened to break any self-holding circuit formed by earlier manipulation of the switches. Energization of the bar down order line 46 energizes the relay 461 provided in car 1, since the contact 62' of the relay 6 on the contact 72' of the relay 7 in FIG. 4a is normally closed. Energizing of the relay 461 drives the piston cylinder mechanism 29 shown in FIG. 5a to move the rod 29' in the direction of arrow *f*, rotating the connecting rod 20 in the direction of arrow *d*. The metal fork 23 is turned around the axis of the rod 20 in the direction of arrow d. Thus, the fastening bars 19 are displaced downwardly. When the magnets $M_1$ on the bars 19 in FIG. 5d come opposite the limit switches $LS_2$, the switches $LS_2$ close. The limit switches $LS_2$ are positioned such that when the fastening bars 19 are brought down to the level where the magnets $M_1$ are opposite the switches $LS_2$, the heads 191 are below the top flange of the I beam. Closing of said limit switches $LS_2$ ends the downward displacement of the fastening bar 19. Relay 462 is connected in series with the limit switches $LS_2$ in the car, as shown in FIG. 4h, and is energized when all the limit switches $LS_2$ for detecting the downward displacement of all fastening bars in the car 1 are closed. Energizing of said relay 462 will close the contact 462' in FIG. 4c, thereby energizing the relay 9 in car 1 and lighting lamp $L_1$ in FIG. 2. Likewise, in the cars 2, 3 and 4, the closing of all the limit switches $L_2$ for detecting the downward displacement of all fastening bars will result in lighting of the lamps $L_2$, $L_3$ and $L_4$.

With the system of the present invention, the advantages are that:

1. No matter what the number, the direction or the relative position in a train of cars, an order can be issued from the dispatcher room to any individual car in a newly formed train, and an order fulfilled signal can be transmitted from that individual car to the dispatcher room. Therefore, the present invention can best be applied to a train which is often subjected to makeup, breakup and directional change; and 2. There is no need for providing a receiver in each car for receiving a specific frequency alloted to that individual car. Therefore, the system of the present invention can achieve economical exchange of an instructional signal and an order fulfilled signal in a train made up of a large number of cars.

What is claimed is:

1. A system for issuing instructional signals to individual cars of a train for causing actuation of a means of said individual car, said system comprising:

a plurality of instructional signal lines extending in an array parallel to each other through each car in a direction parallel to the direction of travel of the car, the number of said lines being at least as great as the number of cars in the train;

a plurality of feedback lines extending in an array parallel to each other through each car in a direction parallel to the direction of travel of the car, the number of lines being at least as great as the number of cars in the train;

two pluralities of terminals at each end of each car corresponding in number to the number of instructional signal lines and the number of feedback lines, respectively, and the terminals in each plurality corresponding in position to the positions of the respective lines in the respective arrays of lines, the one ends of the lines being connected to the terminals at one end of each car in positional correspondence with said lines, and the other ends of the lines in each car being connected to terminals offset by one from the terminals in positional correspondence with the respective lines and the other end of the line on one edge of each array extending across the array and being connected to the terminal in positional correspondence with the line on the other edge of the array, and connections between the terminals in adjacent cars;

instructional signal receiving relay means in each car coupled to the line on said one edge of each instructional signal line array, and an apparatus in each car coupled to said instructional signal receiving relay means for operation in response to energization of said instructional signal receiving relay means; and order fulfilled signal transmitting relay means in each car coupled to said line on said one edge of each feedback line array and including relay actuating means operatively associated with said apparatus for being actuated upon completion of the operation of said apparatus;

whereby when an instructional signal is supplied to one of said instructional signal lines, the instructional signal receiving relay means in the car in which said instructional signal line is at said one edge of the array of instructional signal lines is energized to actuate the apparatus and upon completion of the operation of the apparatus the actuation of the order fulfilled signal transmitting relay means transmits an order fulfilled signal through the feedback line at said one edge of the array of feedback lines in said car.

2. A system as claimed in claim 1 in which the array of instructional signal lines is on one side of each car in the train, and the array of feedback lines is on the other side of each car, and said instructional signal receiving relay means and said order fulfilled signal transmitting relay means are coupled for acting interchangeably, whereby the direction of the cars can be reversed and the array of feedback lines in the reversed car will become the array of instructional signal lines and the array of instructional signal lines will become the array of feedback lines.

3. A system as claimed in claim 1 in which said instructional signal receiving relay means comprises an instructional signal receiving relay and a connecting line therefor connected to the line on said one edge of each array, a normally closed contact of each relay in the connecting line between the other relay and the corresponding line in the array which is opened on energization of the relay, and a normally open contact of each relay connected to said order fulfilled signal transmitting relay means and the connecting line for the other relay at a point between the normally closed contact and the line of the array, said normally open contact being closed upon energization of the relay.

4. A signal system as claimed in clain 3 in which said order fulfilled signal transmitting relay means comprises an order fulfilled signal transmitting relay, a power source, a normally open contact of said relay connected between the power source and the normally open contacts of said instructional signal receiving relays, and a normally open order fulfilled relay energizing contact connected between said order fulfilled signal transmitting relay and said power source which is closed by completion of the operation of the apparatus.

5. A system as claimed in claim 1 further comprising at least one energizing line for energizing the apparatus, said energizing line extending through all of the cars in series, and further relay means in each car coupled to said energizing line, and a normally open contact of the instructional signal receiving relay means connected between the further relay means and the energizing line.

6. A system as claimed in claim 5 further comprising a plurality of further energizing lines extending in parallel through all of the cars in series, a corresponding relay means coupled to each energizing line in each car, said apparatus having a plurality of parts for carrying out parts of the desired operation, there being a further energizing line and corresponding relay means for each of the parts of the desired operation with the corresponding relay means being operatively associated with the respective parts of the apparatus to cause the corresponding part to operate, and said apparatus having means for indicating the completion of the desired operation of the parts coupled to said order fulfilled signal transmitting relay means for actuating said order fulfilled signal transmitting relay means.

7. A system as claimed in claim 5 in which said apparatus comprises means for locking of containers to a railway car, including a plurality of container fastening bars which are raised to raise a locking head into a corresponding recess in a container and then turned to lock the head into the recess, there being at least one set of fastening bars on each car for each size container carried on the car, each car having a number of energizing lines and further relay means corresponding to the number of types of containers which can be carried on a car, and said further relay means being operatively associated with said means for locking of containers for raising the fastening bars.

8. A system as claimed in claim 7 in which said means for locking of containers to a railway car further has means for indicating that a container is loaded onto a car, means for rotating the container fastening bars in one direction, and means for rotating the container fastening bars in the opposite direction, and means for lowering the fastening bars, said system further comprising a container load energizing line, a fastening bar rotating energizing line, a fastening bar reverse rotating energizing line, and a fastening bar down energizing line, and corresponding relay means for each of said lines operatively associated with the corresponding part of said means for locking of containers, and each of the parts of said means for locking of containers has limit switch means for being actuated upon completion of operation of the corresponding part, said limit switch means being coupled to said order fulfilled signal transmitting relay means for completing an energizing circuit for said order fulfilled signal transmitting relay means.

* * * * *